United States Patent [19]

Kato et al.

[11] 4,124,264

[45] Nov. 7, 1978

[54] ELECTRIC PLUG ASSEMBLY

[75] Inventors: Shinichi Kato; Kiyoto Watanabe, both of Yokohama; Shuichi Otani, Tokyo, all of Japan

[73] Assignee: Nissan Motor Company, Ltd., Japan

[21] Appl. No.: 783,392

[22] Filed: Mar. 31, 1977

[30] Foreign Application Priority Data

Apr. 5, 1976 [JP] Japan ..... 51-41761

[51] Int. Cl.[2] ..... H01R 13/42

[52] U.S. Cl. ..... 339/59 M; 339/217 S

[58] Field of Search ..... 339/59 R, 59 M, 217 S

[56] References Cited

U.S. PATENT DOCUMENTS

| | | | |
|---|---|---|---|
| 3,083,345 | 3/1963 | Scheller | 339/217 S |
| 3,351,894 | 11/1967 | Kinkaid | 339/217 S |
| 3,514,745 | 5/1970 | Lyon | 339/217 S |
| 3,763,458 | 10/1973 | Taormina | 339/59 R |
| 3,853,389 | 10/1974 | Occhipinti | 339/217 S |
| 3,980,385 | 9/1976 | Hirokawa | 339/217 S |

FOREIGN PATENT DOCUMENTS

| | | | |
|---|---|---|---|
| 1,790,043 | 12/1971 | Fed. Rep. of Germany | 339/59 R |

*Primary Examiner*—Neil Abrams

[57] ABSTRACT

A contact-making pin is inserted in a through hole of a housing in such a manner that at least one stud or projection formed on the pin and a step portion formed in the same are respectively engaged with an elongated notch and a resilient catch member which are provided in the through hole of the housing, the elongated notch being formed to extend from one end of the through hole to a portion near the other end of the same. Thus, the connection of the pin to the housing is tightly achieved.

1 Claim, 17 Drawing Figures

ELECTRIC PLUG ASSEMBLY

The present invention relates in general to a device for making electrical connection between apparatus especially apparatus requiring individual multi channel electrical connection therebetween, and more particularly to an electric plug assembly for making the electric connection by insertion in a receptacle or body.

It is an object of the present invention to provide an improved electric plug assembly in which the insertion of each contact-making pin in a base or housing member is facilitated.

It is another object of the present invention to provide an improved electric plug assembly in which each contact-making pin is firmly engaged and locked in place in a base or housing member even when stress is placed on the assembly.

It is still another object of the present invention to provide an improved electric plug assembly which is simple in construction and is easily fabiricated and assembled.

According to the present invention, there is provided an electric plug assembly for making electrical connection by fixing it to a receptacle, comprising a base member having therein a through hole and an elongate notch which is merged into the through hole and is substantially parallel to the axis of the through hole, the notch being formed to extend from one end of the through hole to a portion near the other end of the through hole; a resilient member fixed to a portion of the surface of the through hole so as to project the free end thereof into the through hole; a contact making pin member having a step portion formed therein, the pin member being adapted to connect at one end thereof to a lead wire; a projection formed on a surface of the pin member to radially outwardly extend from the pin member; the connection of the base member to the contact-making pin member being such that, upon insertion of the pin member into the through hole, the step portion snugly engages with the free end of the resilient member and the projection is disposed in the notch, whereby the pin member is maintained securely in one position and prevented from rotational and pendulous movement thereof with respect to the base member.

Other objects and advantages of the present invention will become more apparent from the following detailed description when taken in conjunction with the accompanying drawings, in which.

Prior to describing the construction of the improved electric plug according to the present invention, a description of the construction of conventional male and female electric pin plugs will be given with the aid of FIGS. 1A and 1B in order to clarify the inventive features of the subject invention.

Figure 1:
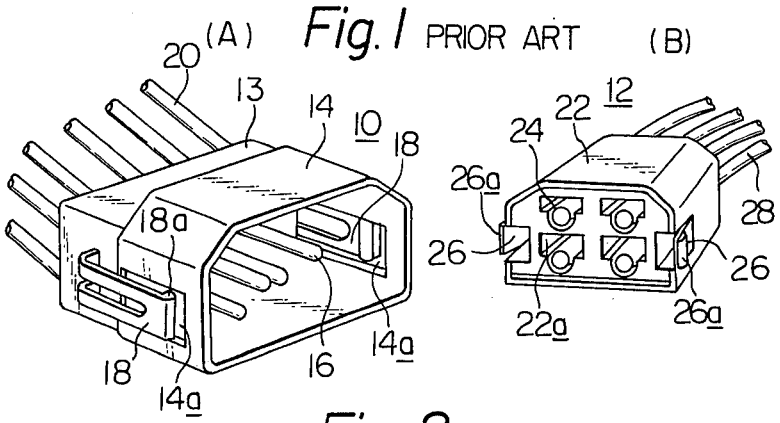
Fig. 1 PRIOR ART
FIGS. 1A and 1B are perspective views of conventional male and female pin electric plugs which are releasably engageable to each other at their contact-making pins.

In FIGS. 1A and 1B, there are illustrated conventional male and female pin electric plugs which are generally designated by the numerals 10 and 12. These plugs 10 and 12 are connectable to each other for making electric connection therebetween.

The male pin electric plug 10 hereinshown generally comprises a base member 13, a cover member 14 both made of plastic, a plurality of spaced male pins 16 stationarily fixed to the base member 13 while being surrounded at the leading ends by the cover member 14 and two hook members 18 fixed at one ends thereof to lateral sides of the base member 13 while allowing the other ends thereof to locate beside respective openings **14*a* formed in the member 14. The other ends of the hook members 18 are formed with latch portions 18*a*. The male pins 16 are connected to lead wires 20** which lead to the electrical equipment.

The female pin electric plug 12 hereinshown comprises a base or housing member 22 made of plastic, a plurality of spaced female pins 24 respectively and stationary received in holes **22*a* formed in the housing member 22 and two resilient lug members 26 fixed at one ends thereof to lateral sides of the housing member 22 so as to allow the other ends thereof to be laterally swingable in a resilient manner. The other ends of the lug members 26 are formed with latch portions 26*a*. The female pins 24 are connected to lead wires 28** leading to other electrical equipment (not shown).

When the electrical connection between the electrical equipment (not shown) is required, the female pin electric plug 12 is coupled with the male pin electric plug 14 so that the latch portions **26*a* of the lug members 26 are brought into engagement with the latch portions 18*a* of the hook members 18. In this state, the male pins 16 of the male pin electric plug 14 are engaged with or inserted into the corresponding female pins 24 of the female pin electric plug 12** to provide electrical connection therebetween.

Figure 2:
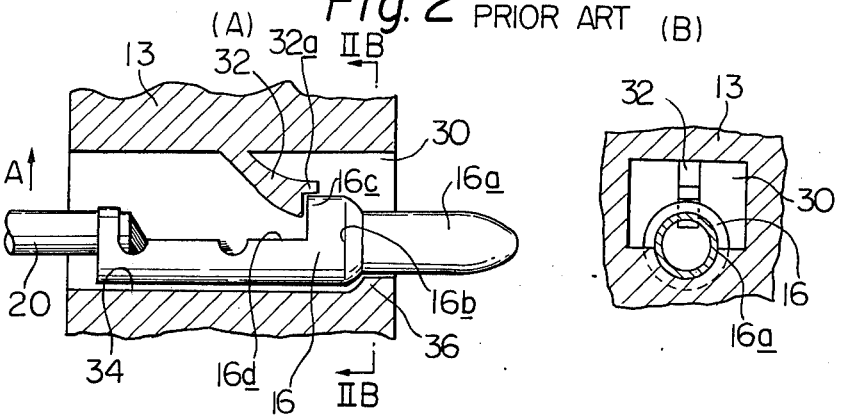
Fig. 2 PRIOR ART
FIG. 2A is a partial side sectional view, on an enlarged scale, of the conventional male pin electric plug shown in FIG. 1A.
FIG. 2B is an axial sectional view taken along the line IIB—IIB of FIG. 2A.

The manner of connection between each of the male pins and the base member 13 is shown in FIGS. 2A and 2B. As seen in FIG. 2A, the base member 13 is formed with a through hole 30 of a rectangular cross section into a which each of the male pins 16 is inserted. The insertion of the male pin 16 in the hole 30 is initiated from the left side, as seen in the drawings, of the hole 30.

Integrally formed at its one end portion to and extending from the surface of the through hole 30 is a resilient member 32 which projects the other end thereof into the through hole 30. The other end of the resilient member 32 is formed with a catch portion 32a which is used for catching and supporting the male pin 16. A groove 34 having a semicircular cross section is formed in the base member 13 so as to merge into the through hole 30 and extend parallel to the axis of the through hole 30. It should be noted, as is shown in FIG. 2A, that the groove 34 extends from one or left end of the through hole 30 to a portion near the other or right end of the through hole 30. In other words, the leading end of the groove 34 provides the portion with a step 36 which is used for stopping the rightward movement of the male pin 16.

On the other hand, the male pin 16 is formed of an elongate cylindrical tube having a contact-making male section 16a projecting into the cover member 14 and has a shoulder portion 16b at a portion from which the male section 16a extends, and a step portion 16c at a portion from which a cut out portion 16d extends. Although not shown well, the cut out portion 16d is provided at the left section thereof, in this drawing, with a wire fastening section to which the naked leading end of the wire 20 is fastened.

Figure 3:
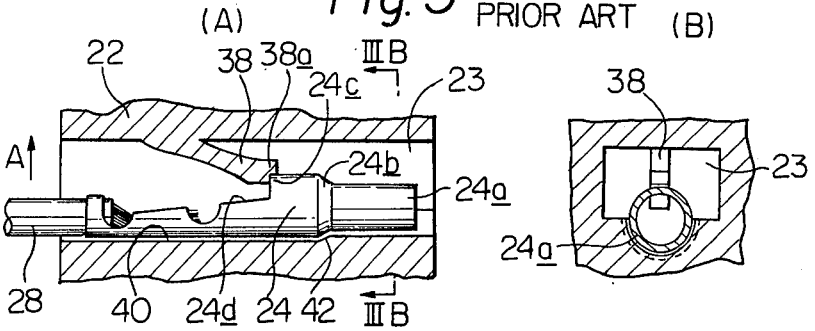
Fig. 3 PRIOR ART
FIG. 3A is a partial side sectional view, on an enlarged scale, of the conventional female pin electric plug shown in FIG. 1B.
FIG. 3B is an axial sectional view taken along the line IIIB—IIIB of FIG. 3A.

As seen from FIGS. 3A and 3B, the connection manner between each of the female pins 24 and the housing member 22 of the female pin electric plug 12 is very similar to the case of the male electric plug 10. Also in this case, the base or housing member 22 has a through hole 23 of a rectangular cross section into which each of the female pins 24 is inserted. A resilient member 38 with a catch portion 38a is integrally formed with and extends from the surface of the through hole 23. A groove or recess 40 having a simicircular cross section is formed in the housing member 22 while merging with the through hole 23 and extends substantially parallel to the axis of the hole 23. The groove 40 terminates at a portion near the right end of the through hole 23 to form a step 42.

The female pin 24 is formed to have a contact-making female section 24a, a shoulder portion 24b, a step portion 24c and a cut out portion 24d. The female pin 24 is connected to a lead wire 28. The whole female pin 24 is located within the through hole 23, this manner being different from the case of the male pin electric plug 10.

However, in these prior art electric plugs 10 and 12, there will arise the following problem, that is: When a certain amount of force is applied to the wire 20 or 28 from a direction indicated by an arrow (A), the pin 16 or 24 is urged to swing upwardly about the step portion 16c or 24c thereof contacting the catch portion 32a or 38a of the resilient member 32 or 38. This means that the connection of the female pin electric plug 12 to the male pin electric plug 10 is very difficult due to such swingable movements of the pins 16 and 24. In the worst case, the resilient members 32 and 38 are subjected to breaking during their connecting operation. Furthermore, in this conventional case, it may occur that the pins 16 and 24 are rotated about the axes thereof when the wires 20 and 28 to which the pins 16 and 24 are connected are extensively twisted. This rotation of the pin 16 or 24 will induce the disengagement of the step portion 16c or 24c from the catch portion 32a or 38a, thereby causing the pin to be disengaged or removed from the base or housing member 13 or 22, accidently.

Therefore, the main object of the present invention is to eliminate such drawbacks encountered in the prior art male and female pin electric plugs.

Figure 4:
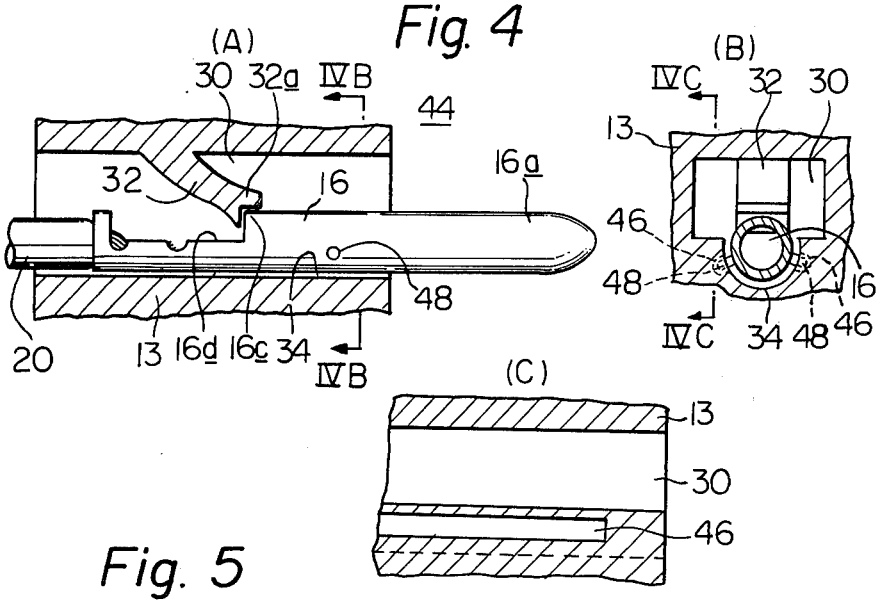
FIG. 4A is a partial side sectional view, on an enlarged scale, of a male pin electric plug embodying the present invention.
FIG. 4B is an axial sectional view taken along the line IVB—IVB of FIG. 4A.
FIG. 4C is a side sectional view taken along the line IVC—IVC of FIG. 4B.

Referring to FIGS. 4A to 4C, there is illustrated a portion of a male pin electric plug embodying the present invention, the plug being generally designated by the reference numeral 44. For facilitation, the parts substantially the same as those shown in FIGS. 2A and 2B will be designated by the same numerals used therein. The male pin electric plug 44 generally comprises a base member 13 made of a plastic having therein a through hole 30 of a rectangular cross section. Although not shown in these drawings, a cover member covering the male pins 16 is fixed to the base member 13 in the before-mentioned conventional manner. A resilient member or portion 32 with a hook or catch portion 32a is integrally formed with and extends from the surface of the through hole 30. Preferably, the resilient member 32 is relatively thick for providing adequate resiliency. A groove 34 having a semicircular cross section is provided in the base member 13 so as to merge with the through hole 30. The groove 34 of this embodiment is arranged to extend from the left end to the other or right end of the through hole 30. In this embodiment, the base member 13 is formed further with a pair of elongated notches 46 which are merged with the groove 34 and extend parallel to the axis of the groove 34. This will be well understood from FIGS. 4B and 4C. From these drawings, it will be appreciated that the pair of notches 46 are located in generally symmetrical positions with respect to the axis of the groove 34 and the right ends of the notches 46 terminate at a portion near the right end of the through hole 30.

The male pin 16 is formed like an elongate tube having a contact-making male section 16a projecting into the cover member (not shown) and has a step portion 16c at a portion from which a cut out portion 16d extends. The cut out portion 16d is provided at the left section thereof with a wire fastening section to which a wire 20 is firmly connected. Now, it should be noted that the male pin 16 further has a pair of studs 48 at the cylindrical surface thereof. As well seen from FIG. 4B, the studs 48 are arranged to slidably engage with the respective notches 46 upon insertion of the male pin 16 in the through hole 30 and more particularly in the groove 34.

In assembling the male pin electric plug 44, the male pin 16 is inserted in the through hole 30 from the left of the hole 30. The contact-making male section 16a of the male pin 16 is inserted into the through hole 30 and is moved axially to the right as viewed in FIG. 4A. In this instance, the studs 48 are engaged to the notches 46 so that the movement of the male pin 16 is guided by the notches 46. The male section 16a continues to move past the catch portion 32a of the resilient member 32. As the generally cylindrical male section 16a moves over the catch portion 32a, the resilient member 32 is deflected in an upward direction. As the male section 16a continues to be moved to the right, the step portion 16c defined by the cut out portion 16c is finally trapped by the catch portion 32a and at the same time, the studs 48 reach the ends of the notches 46, the trapping allowing the resilient member 32 to partially return toward its original generally underpressed disposition. Thus, in this state, the male pin 16 is tightly locked in place. It should be noted that further axial movement of the male pin 16 to the right or the left is prevented. The resilient member 32 urges the male pin 16 into firm contact with the groove 34 via the studs 48 by the resiliency thereof. Now, it should be noted that by the engagement of the studs 48 and the notches 46, the unwanted upward swing or pendulous motion of the male pin 16 about the step portion 16*c* is prevented. If desired, the studs 48 may be located asymmetrically with respect to the axis of the male pin 16. By this, the rotative movement of the male pin 16 about the step portion 16*c* is completely prevented. Furthermore, in this case, the rotation of the male pin 16 about the axis thereof is also prevented.

Figure 5:
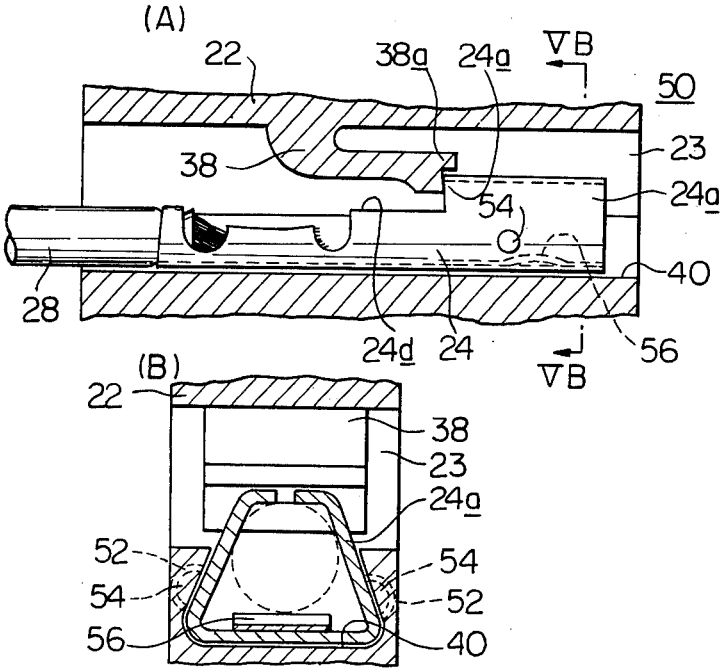
FIG. 5A is a partial side sectional view, on an enlarged scale, of a female pin electric plug embodying the invention.
FIG. 5B is an axial sectional view taken along the line VB—VB of FIG. 5A.

Referring to FIGS. 5A and 5B, there is shown a portion of a female pin electric plug also embodying the subject invention, the plug being generally designated by the numeral 50. For facilitation of the explanation of this case, the same parts designated by numerals in FIGS. 3A and 3B are designated by the same numerals is in FIGS. 5A and 5B. The construction of the female pin electric plug 50 of this embodiment is very similar to that of the male pin electric plug 44 mentioned above. The female pin electric plug 50 generally comprises a base or housing member 22 made of a plastic, having therein a through hole 23 of a rectangular cross section into which each of female pins 24 is snugly disposed in a manner as will be described hereinafter. A resilient member or portion 38 with a catch portion 38*a* is integrally formed with and extends from the surface of the through hole 23. The resilient member 38 is formed to have a relatively large cross section for providing adequate resiliency. A groove 40 having a trapezoidal cross section is formed in the housing member 22 so as to merge with through hole 23. As shown in FIG. 5B, the side walls defining the sides of the groove 40 gradually approach each other as they approach the through hole 23. The groove 40 extends from one or left end of the through hole 23 to the other or right end of the through hole 30 as shown in FIG. 5A. In generally the same manner as in the case of the male pin electric plug 44 mentioned above, the housing member 22 is further provided at the side walls with a pair of notches 52 which are merged into the groove 40. The notches 52 extend substantially parallel to the longitudinal axis of the groove 40. The notches 52 extend from the left end of the through hole 23 and terminate at a portion near the right end of the through hole 23.

The female pin 24 is formed like an elongate hollow bar having a contact-making female section 24*a* of a generally trapezoidal cross section, and has a step portion 24*c* from which a cut out portion 24*d* extends. The cut out portion 24*d* is provided at the left section thereof with a wire fastening section to which a wire 28 is connected. As shown in FIG. 5B, a pair of studs 54 are firmly fixed to respective sides of the female section 24*a* of the female pin 24. These studs 54 are respectively and longitudinally slidably engaged with the notches 52 upon insertion of the female pin 24 in the through hole 23 and more particularly in the groove 40. Indicated by the numeral 56 is a spring plate which is connected to a base of the contact-making female section 24*a* for achieving more reliable electrical connection between the female pin 24 and the before-mentioned male pin 16 upon insertion thereof thereto. Now, it should be appreciated that if the female pin 24 is formed to have a trapezoidal cross section which is similar to but slightly smaller than that of the groove 40, the studs 54 and the notches 52 may be omitted. This is because that the sliding engagement of the female pin 24 with the groove 40 can prevent the upward swing of the female pin 24.

Since the assemblage of the female electric plug 50 is generally the same as the male electric plug 44 mentioned above, a description of same will be omitted.

Figure 6:
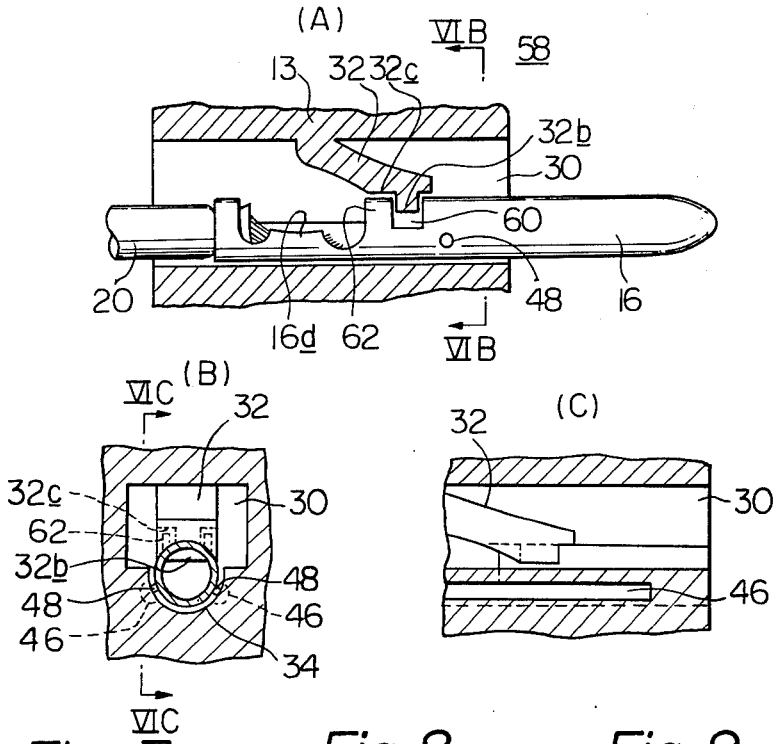
FIG. 6A is a partial side sectional view, on an large scale, of another male pin electric plug embodying the invention.
FIG. 6B is an axial sectional view taken along the line VIB—VIB of FIG. 6A.
FIG. 6C is a side view taken along the line VIC—VIC of FIG. 6B.

Referring to FIGS. 6A to 6C, there is shown another embodiment of a male pin electric plug of the invention, the plug being generally designated by the reference numeral 58. The male pin electric plug 58 comprises generally same parts as in the case of the before-mentioned male pin electric plug 44 shown in FIGS. 4A to 4C. Thus, in this case, the parts similar to those of the plug 44 are designated by the same numerals as in the case of FIGS. 4A to 4C. The resilient member or portion 32 of this embodiment is formed at its free end with a downwardly extending projection 32*b* and a pair of parallel recesses 32*c*, the recesses 32*c* being located behind the projection 32*b* and extending substantially parallel to the longitudinal axis of the through hole 30.

The male pin 16 is formed at a portion between a pair of studs 48 and a cut out portion 16*d* with another cut out portion 60 into which the above-mentioned projection 32*b* is trapped for the tight connection of the male pin 16 to the base member 13. Furthermore, the male pin 16 is provided at a portion near the cut out portion 60 with a pair of upwardly extending guide plate portions 62 which are respectively engaged with the pair of parallel recesses 32*c* upon final fitting of the male pin 16 to the base member 13. In accordance with this additional attachment, the setting of the male pin 16 in the base member 13 is more effectively made.

Figure 7:
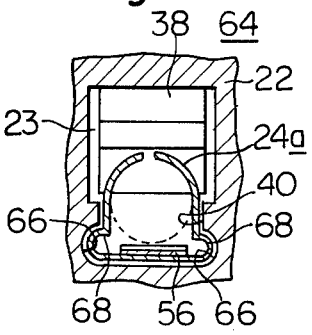
FIGS. 7 to 9 are partial axial sectional views, on an large scale, of other female pin electric plug embodying the invention.
Figure 8:
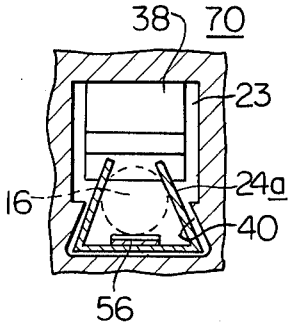
Figure 9:
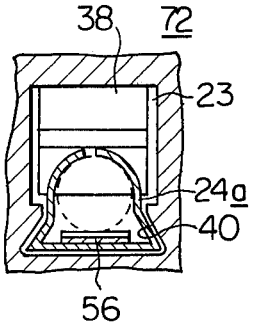

Referring to FIGS. 7 to 9, there are illustrated other embodiments of the female pin electric plug of the subject invention. Also in these cases, the parts similar to those of the female pin electric plug 50 shown in FIGS. 5A and 5B are designated by the same numerals as in the case of same.

In FIG. 7, the female pin electric plug 64 is shown as including the housing member 22 having therein a groove 40 merged with a through hole 23. A pair of parallel notches 66 each having a substantially semicircular cross section are formed at lower sections of side walls defining the groove 40 so as to be parallel to the longitudinal axis of the groove 48. The female pin 24 is formed to have at least at its contact-making female section 24*a* a pair of laterally extending projections 66 which are respectively inserted in the notches 66 mentioned above upon connection of the female pin 24*a* to the housing member 22. In this embodiment, the contact-making female section 24*a* is illustrated as having a semicircular cross section at the upper portion thereof.

In case of FIG. 8, the female pin electric plug 70 has a groove 40 the cross section of which is substantially trapezoidal. The female pin 24 is formed to have at least at the contact-making female portion 24 thereof a trapezoidal cross section which is substantially similar to but slightly smaller than that of the above-stated groove 40. The inwardly inclined side walls forming the contact-making female section 24*a* are resilient, so that the insertion of the male pin 16 in the female portion 24*a* will provide firm contact with the same. Thus, in this case, the spring plate 56 may be omitted.

In case of FIG. 9, the female pin electric plug 72 is generally same as the plug 64 shown in FIG. 7 except for the form of the notches 66. In this case, the cross section of the groove 40 is substantially triangular.

Now, it should be noted, by the reasons mentioned in the description on the female pin 24 of FIGS. 5A and 5B, that the studs 54 may be omitted from these constructions of FIGS. 7 to 9.

With these constructions of the male and female pin electric plugs mentioned above, it will be understood that these plugs of the invention can contributer substantially to a firm connection between the pins and the base or housing members thereof, thereby reducing the possibility of failure of these plugs, which can been encountered in the prior art, even when stress is placed on the same.

What is claimed is:

1. An electric plug comprising:

a base member having therein parallel first and second through passages which are merged with each other, a surface portion defining said second through passage being formed with a pair of elongate notches which extend substantially parallel to the axis of said second through passage from one extreme end of said second through passage to a portion of said surface portion near the other extreme end of said second through passage;

a resilient tongue member integrally connected to a surface defining said first through passage so as to project the free end thereof into said first through passage, said free end of said resilient tongue member being formed into a catch portion which has a pair of spaced parallel recesses extending substantially parallel to the longitudinal axis of said first through passage;

a contact making pin member having therein a caught portion which is engageable with said catch portion of said resilient tongue member, said pin member being adapted to be inserted into said second through passage for the connection therebetween;

a pair of guide plate portions formed on said pin member;

a pair of projections provided on a surface of said pin member to radially outwardly extend from the same;

the connection of said pin member with said base member made such that upon final fitting of said pin member to said base member, said catch portion catches said caught portion to prevent said pin member from a longitudinal movement toward said one extreme end of said second through passage, said pair of guide plate portions are respectively received in said parallel recesses of said tongue member for preventing said pin member from rotational and pendulous movements thereof about the axis thereof with respect to said second through passage, and said pair of projections are respectively received in said elongate notches at said portion near said surface portion near the other extreme end of said second through passage thereby to prevent said pin member from a longitudinal movement toward the other extreme end of said second through passage.

* * * * *